US007160145B2

(12) United States Patent
Barrat et al.

(10) Patent No.: US 7,160,145 B2
(45) Date of Patent: Jan. 9, 2007

(54) DOUBLE-COMB INTERCONNECTION DEVICE

(75) Inventors: Sylvain Barrat, Belleville sur Saone (FR); Stéphane Prost, Arnas (FR)

(73) Assignee: ABB Entrelec, Villeurbanne (FR)

( * ) Notice: Subject to any disclaimer, the term of this patent is extended or adjusted under 35 U.S.C. 154(b) by 0 days.

(21) Appl. No.: 10/538,170

(22) PCT Filed: Nov. 12, 2003

(86) PCT No.: PCT/FR03/03353

§ 371 (c)(1),
(2), (4) Date: Jun. 9, 2005

(87) PCT Pub. No.: WO2004/066448

PCT Pub. Date: Aug. 5, 2004

(65) Prior Publication Data

US 2006/0110975 A1 May 25, 2006

(30) Foreign Application Priority Data

Dec. 23, 2002 (FR) ..... 02 16548

(51) Int. Cl.
*H01R 31/08* (2006.01)

(52) U.S. Cl. ..... 439/511

(58) Field of Classification Search ..... 439/511, 439/71, 72, 68, 83, 608, 884, 887, 891
See application file for complete search history.

(56) References Cited

U.S. PATENT DOCUMENTS

| | | | | |
|---|---|---|---|---|
| 6,299,492 | B1 * | 10/2001 | Pierini et al. | 439/884 |
| 6,375,508 | B1 * | 4/2002 | Pickles et al. | 439/608 |
| 6,923,657 | B1 * | 8/2005 | Brown et al. | 439/71 |

FOREIGN PATENT DOCUMENTS

| | | |
|---|---|---|
| DE | 42 23 540 A1 | 1/1994 |
| DE | 44 11 306 C1 | 5/1995 |
| DE | 195 42 628 C1 | 2/1997 |
| EP | 0 678 934 A1 | 10/1995 |

* cited by examiner

*Primary Examiner*—Chandrika Prasad
(74) *Attorney, Agent, or Firm*—Oliff & Berridge, PLC

(57) ABSTRACT

The invention concerns an interconnect device in particular for connection and/or line terminals arranged on-line, comprising first and second interconnect combs facing each other and comprising each a connecting bar, and teeth, extending substantially perpendicularly from the connecting bar, the device comprising elastic teeth and rigid teeth. The teeth of each of the first and second combs are alternately rigid and elastic. The elastic teeth and the rigid teeth of the first comb are located respectively opposite the rigid teeth and the elastic teeth of the second comb.

9 Claims, 3 Drawing Sheets

DOUBLE-COMB INTERCONNECTION DEVICE

The present invention relates to the interconnect devices used in particular although not exclusively to interconnect connection and/or linking terminals arranged in a line.

More specifically, the invention relates to an interconnect device comprising a first and a second interconnect comb which are arranged facing each other and each comprise a linking bar and teeth which extend more or less perpendicularly from the linking bar, the device comprising elastic teeth and rigid teeth.

Thus, such an interconnect device is used to join several electric conductors and place them at the same potential. More particularly, this device allows the interconnection of conducting strips in which slots are made each intended to receive two teeth of the device which are situated facing each other.

Such devices are particularly known from document EP-678 934, in which devices two interconnect combs are arranged facing each other. One of these combs comprises only rigid teeth and the other comb comprises only elastic teeth, the rigid teeth being made of an electrically conducting material so as to allow current to pass while the elastic teeth are made of stainless steel and have enough elasticity to provide a good contact with the rigid teeth. In order to obtain a good spring effect, the elastic teeth are deformed in such a way that the interconnect device in its entirety is unbalanced, it may, for example, become inclined under the effect of the elastic forces all acting in the same direction. In addition, given that, in a pair of teeth situated facing each other, only one is conducting, a heating effort occurs due to the passing of the current.

Also known, from document DE-42 23 540, are interconnect devices which comprise two combs in which all the teeth are conducting and elastic. Even though this device has the advantage of being balanced because two teeth facing each other are symmetric, no tooth is able to react the elastic forces exerted by the other teeth which means that this device experiences a great deal of stress.

It is a particular object of the present invention to remedy these disadvantages by providing an interconnect device which is balanced while at the same time having good electrical conductivity and to do so using means that are simple, effective and inexpensive.

To this end, according to the invention, the interconnect device of the aforementioned type is essentially characterized in that the teeth of each of the first and second combs are alternately rigid and elastic, and in that the elastic teeth and the rigid teeth of the first comb are situated respectively facing the rigid teeth and the elastic teeth of the second comb.

By virtue of these measures, the interconnect device has pairs of teeth in which one of the teeth is capable of reacting the elastic forces of the other of the teeth while each pair of teeth exerts an elastic force the direction of which is the opposite of the elastic force exerted by the adjacent pair. The interconnect device is thus balanced overall.

In a preferred embodiment, the teeth of the first and second combs are all made of an electrically conducting material. Thus, in each pair of teeth, one of the teeth does not experience a greater rise in temperature than the other of the teeth.

As a preference, the elastic teeth each comprise a base portion and an end portion which make an obtuse angle between them.

Still as a preference, the base portion makes an angle with the plane in which the linking bar lies.

As an alternative, the elastic teeth each comprise a depression the length of which is short by comparison with the length of the teeth, which faces away from the rigid tooth opposite and extends over the base and end portions.

Still as a preference, the rigid teeth are of concave cross section, the concave side facing towards the elastic tooth opposite.

As an alternative, the elastic teeth and the rigid teeth each have free ends which converge towards the tooth opposite.

For preference, the linking bars of the first and second combs are formed together as an integral part, being folded over one onto the other.

As an alternative, the first and second combs are made of a copper-containing alloy.

Other features and advantages of the present invention will become apparent in the course of the following description of one of its embodiments, given by way of nonlimiting example with reference to the attached drawings in which.

Figure 1:
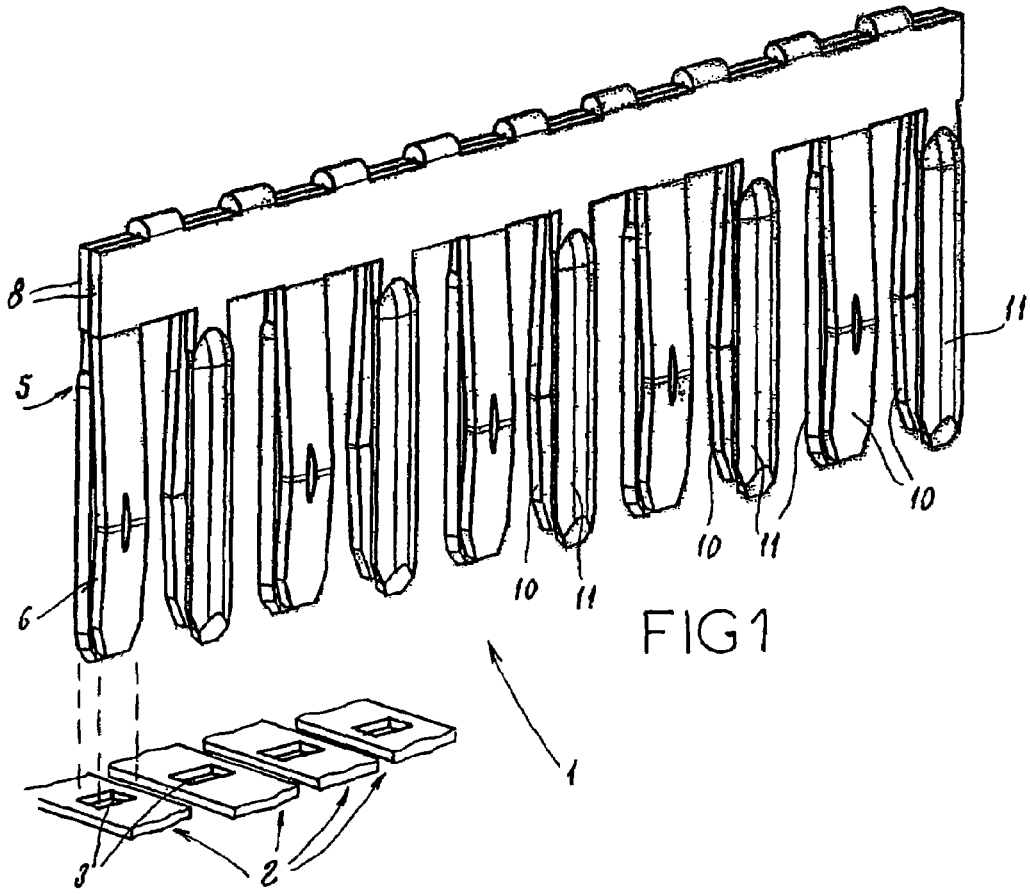
FIG. 1 is a perspective view of the interconnect device according to the present invention, ready to be inserted in linking strips.

FIG. 1 depicts an interconnect device 1 and four linking strips 2 which are associated with a connection and/or linking terminal, not depicted. These linking strips are arranged in a line and each comprise a slot 3 of more or less rectangular shape, running transversely with respect to the strip. The various slots 3 are aligned with one another in order to allow an interconnection to be made between at least two linking strips 2.

The interconnect device 1 comprises a first interconnect comb 5 and a second interconnect comb 6 which are arranged facing each other. Each of these two interconnect combs 5, 6 has a linking bar 8 also known as the base of the comb. From each of these linking bars 8 there extends a certain number of teeth. In this particular instance, each comb comprises ten teeth which extend more or less perpendicularly from the respective linking bar 8, and which are distributed in two groups of teeth; elastic teeth 10 on the one hand, and rigid teeth 11 on the other.

According to an essential feature of the present invention, in each of the first 5 and second 6 interconnect combs, the succession of teeth comprises, alternately, elastic teeth 10 and rigid teeth 11. Each tooth of the first comb 5 is situated facing a tooth of the second comb 6 and the elastic teeth 10 of the first comb 5 are offset with respect to the elastic teeth 10 of the second comb 6 so that an elastic tooth 10 of the first comb 5 is situated opposite a rigid tooth 11 of the second comb 6.

Thus, each pair of teeth situated facing each other comprises an elastic tooth and a rigid tooth and, in the succession of pairs of teeth of the interconnect device 1, each pair is the mirror image of an adjacent pair.

In the current embodiment depicted in the figures, each elastic tooth 10 and rigid tooth 11 is of rectangular overall shape and is made of an electrically conducting material.

Figure 2:
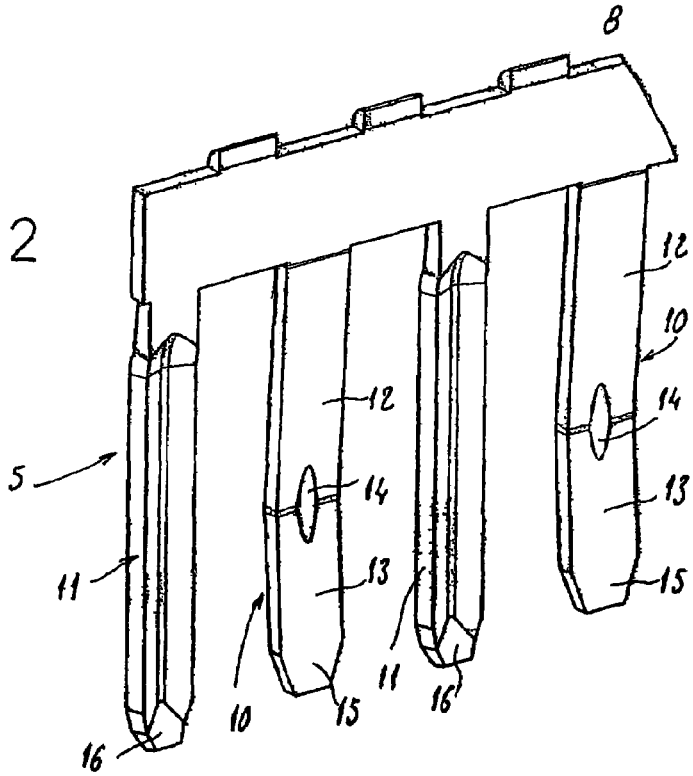
FIG. 2 is a partial perspective view of one of the combs of the interconnect device of FIG. 1.
Figure 3:
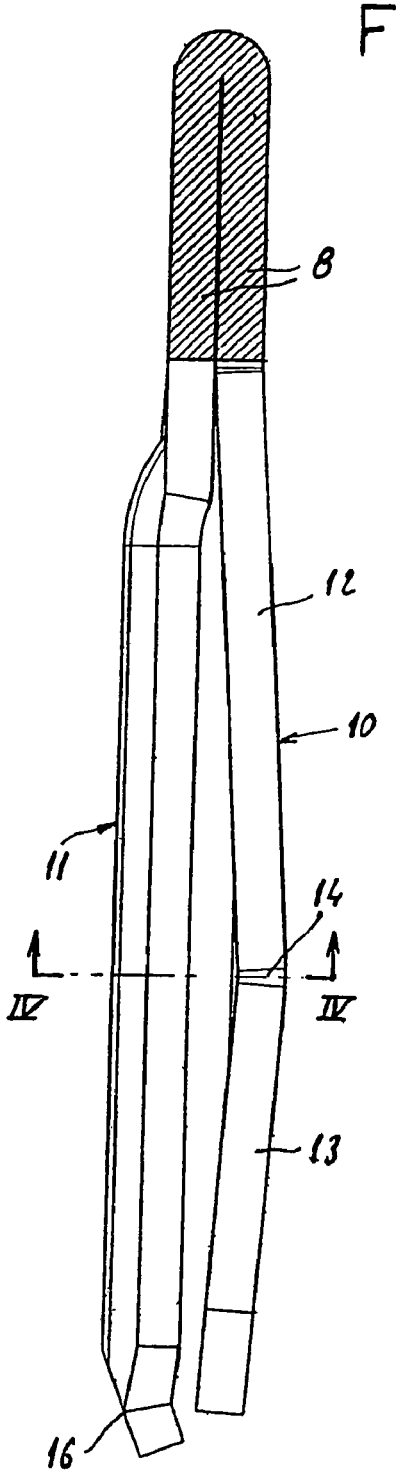
FIG. 3 is a side view of two teeth situated facing each other belonging to the first and to the second combs of the interconnect device.
Figure 4:
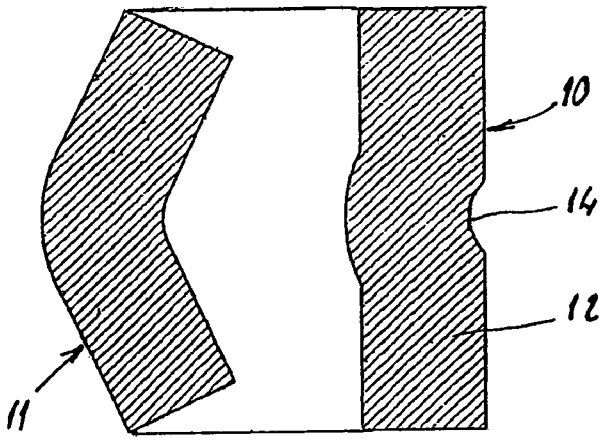
FIG. 4 is a view in section on IV—IV of FIG. 3.

As depicted more particularly in FIGS. 2 to 4, each elastic tooth 10 comprises a base portion 12 situated on the same side as the linking bar 8 and an opposite end portion 13, situated further forward in the direction in which the tooth is introduced into one of the linking strips 2. The base portion 12 makes an acute angle with the end portion 13 so that the elastic tooth 10 is elastically deformable perpendicular to the plane of the interconnect device 1.

In order to enhance this elastic effect, the base portion 12 makes a certain angle with the linking strip 8 which supports it, so that this base portion 12 is inclined with respect to the plane of the interconnect device 1. Each elastic tooth 10 further comprises a depression 14 which extends both over the base portion 12 and over the end portion 13. This depression has a length which is short by comparison with the length of the tooth supporting it and faces away from the rigid tooth 11 opposite. This depression 14 is, for example, produced by pressing the tooth 10, and makes it possible to improve still further the contact with the slot 3 of the strip 2 in which the tooth is intended to be inserted.

The rigid teeth 11 extend more or less in the plane defined by the interconnect comb 1, having a cross section of concave shape, the concave side of which faces towards the elastic tooth 10 opposite. This concave shape extends over practically the entire length of the tooth and gives the tooth 11 good rigidity.

The elastic teeth 10 and the rigid teeth 11 also each have free ends 15, 16 situated at the ends of these teeth and which converge towards the tooth opposite. These folded-over ends 15 and 16 make inserting the teeth into the slots 3 of the linking strips 2 easier.

Figure 5:
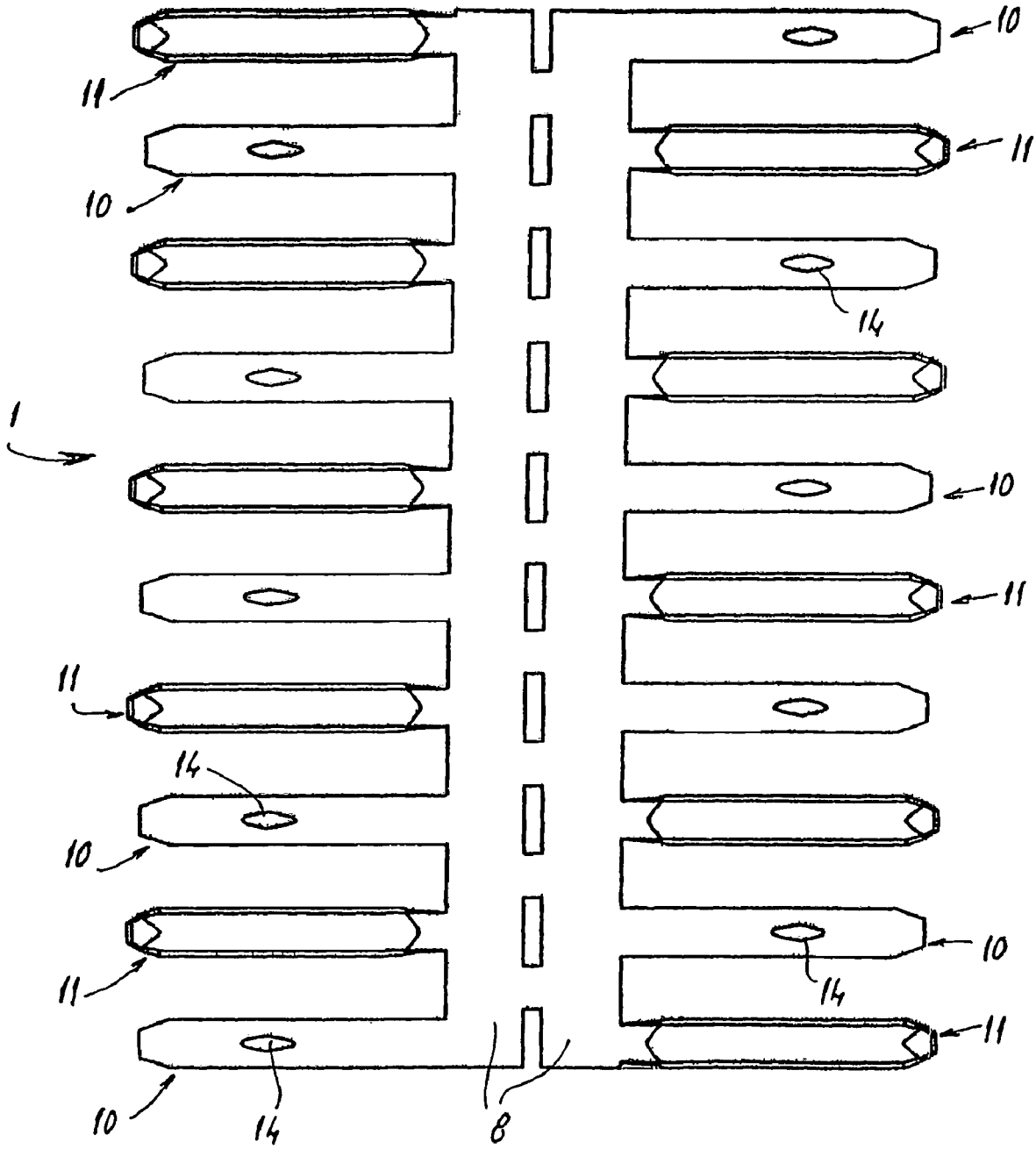
FIG. 5 is a view from above of the interconnect device in the process of being manufactured, before the two combs are folded over one onto the other.

As shown more particularly in FIG. 5, the first comb 5 and the second comb 6 are preferably formed together as an integral part at their respective linking bars 8. Thus, the entire interconnect device 1 is produced in the flat state by cutting, pressing and folding. After cutting and pressing, the two combs 5 and 6 are folded one onto the other by folding at their linking bars 8.

The interconnect device 1 according to the present invention affords a great improvement to the existing art by providing an interconnect comb the structure of which is balanced because the forces exerted by each elastic tooth in a pair are in opposite directions to the forces of the elastic tooth of the adjacent pair. In addition, given that the entire interconnect device is made of a copper-containing alloy, all the teeth are conducting and there is therefore no temperature rise of one of the teeth with respect to the others.

As goes without saying, the invention is not restricted to the sole embodiment of the two combs described hereinabove by way of example; on the contrary, it encompasses all variants thereof. Thus, in particular, the number of constituent teeth could be just two, without departing from the scope of the present invention.

The invention claimed is:

1. An interconnect device particularly for connection and/or linking terminals arranged in a line, comprising a first and a second interconnect comb which are arranged facing each other and each comprise a linking bar and teeth which extend more or less perpendicularly from the linking bar, the device comprising elastic teeth and rigid teeth, characterized in that the teeth of each of the first and second combs are alternately rigid and elastic, and in that the elastic teeth and the rigid teeth of the first comb are situated respectively facing the rigid teeth and the elastic teeth of the second comb.

2. The interconnect device as claimed in claim 1, characterized in that the teeth of the first and second combs are all made of an electrically conducting material.

3. The interconnect device as claimed in claim 1, characterized in that the elastic teeth each comprise a base portion and an end portion which make an obtuse angle between them.

4. The interconnect device as claimed in claim 3, characterized in that the base portion makes an angle with the plane in which the linking bar lies.

5. The interconnect device as claimed in claim 3, characterized in that the elastic teeth each comprise a depression the length of which is short by comparison with the length of the teeth, which faces away from the rigid tooth opposite and extends over the base and end portions.

6. The interconnect device as claimed in claim 1, characterized in that the rigid teeth are of concave cross section, the concave side facing towards the elastic tooth opposite.

7. The interconnect device as claimed in claim 1, characterized in that the elastic teeth and the rigid teeth each have free ends which converge towards the rigid teeth and elastic teeth, of the other interconnect comb, respectively.

8. The interconnect device as claimed in claim 1, characterized in that the linking bars of the first and second combs are formed together as an integral part, being folded over one onto the other.

9. The interconnect device as claimed in claim 2, characterized in that the first and second combs are made of a copper-containing alloy.

* * * * *